US008136458B1

(12) United States Patent
Cass et al.

(10) Patent No.: US 8,136,458 B1
(45) Date of Patent: Mar. 20, 2012

(54) CLOTHESLINE APPARATUS

(76) Inventors: Dean A. Cass, Vermont (AU); Stephen J. Garrett, Montrose (AU); Scott D. Ferguson, Ringwood East (AU)

( * ) Notice: Subject to any disclaimer, the term of this patent is extended or adjusted under 35 U.S.C. 154(b) by 436 days.

(21) Appl. No.: 12/412,336

(22) Filed: Mar. 26, 2009

(51) Int. Cl.
*A47B 37/00* (2006.01)

(52) U.S. Cl. ..... 108/50.12; 108/152; 108/42

(58) Field of Classification Search ..... 108/50.11, 108/50.12, 92, 93, 94, 95, 96, 97, 152, 42; 135/16; 211/88.01, 107, 133.1, 133.3, 134, 211/163, 166; 248/161, 157, 127
See application file for complete search history.

(56) References Cited

U.S. PATENT DOCUMENTS

| | | | | | |
|---|---|---|---|---|---|
| 90,785 | A | * | 6/1869 | Ruggles | 108/152 |
| 92,109 | A | * | 6/1869 | Shirey et al. | 108/152 |
| 1,167,934 | A | * | 1/1916 | Roth | 211/41.2 |
| 1,799,079 | A | * | 3/1931 | Bemis | 248/146 |
| 2,918,202 | A | * | 12/1959 | Constantine et al. | 224/276 |
| 2,970,701 | A | * | 2/1961 | Fetter | 211/78 |
| 3,434,484 | A | * | 3/1969 | Dilullo | 135/16 |
| 3,620,174 | A | * | 11/1971 | Dentino | 108/152 |
| 4,448,313 | A | * | 5/1984 | Pomeroy et al. | 211/41.1 |
| 5,114,023 | A | * | 5/1992 | Lavin | 211/107 |
| 5,161,561 | A | * | 11/1992 | Jamieson | 108/94 |
| 5,277,488 | A | | 1/1994 | Cleary et al. | |
| 5,294,012 | A | | 3/1994 | Shott et al. | |
| 5,505,645 | A | * | 4/1996 | Engler, Jr. | 135/16 |
| D407,934 | S | | 4/1999 | Wojtowicz et al. | |
| 5,934,634 | A | | 8/1999 | Lindblom | |
| D417,107 | S | | 11/1999 | Patel et al. | |
| 5,996,511 | A | * | 12/1999 | Swoger | 108/50.12 |
| D448,551 | S | * | 10/2001 | Vong et al. | D3/10 |
| 6,487,977 | B1 | * | 12/2002 | Williams et al. | 108/50.12 |
| 6,666,153 | B2 | | 12/2003 | Dickinson et al. | |
| 6,688,238 | B1 | | 2/2004 | Alexiou | |
| 2004/0129184 | A1 | * | 7/2004 | Kraker | 108/50.12 |

* cited by examiner

*Primary Examiner* — Jose V Chen

(57) ABSTRACT

A clothesline apparatus for holding a laundry basket and clothes pins comprising a bench component, a basket for placing atop the bench component, and a set of containers disposed near the front of the bench component, wherein the set of containers is for storing clothes pins and/or the like. A first wing and a second wing are disposed on the bench component, wherein the clothesline apparatus can be attached to a pole or a wall via clamps wrapping round the first wing and the second wing.

2 Claims, 4 Drawing Sheets

CLOTHESLINE APPARATUS

FIELD OF THE INVENTION

The present invention is directed to an apparatus for holding a laundry basket and clothes pins on a clothesline pole or a wall.

BACKGROUND OF THE INVENTION

The present invention features a clothesline apparatus for holding a laundry basket and/or clothes pins. The clothesline apparatus may be attached to a clothesline pole or a wall at a certain height above the ground surface. The clothesline apparatus comprises a bench component and a basket for placing on top of the bench component. The clothesline apparatus further comprises a set of containers disposed near the front edge of the bench component, wherein the set of containers is for storing clothes pins and/or the like.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
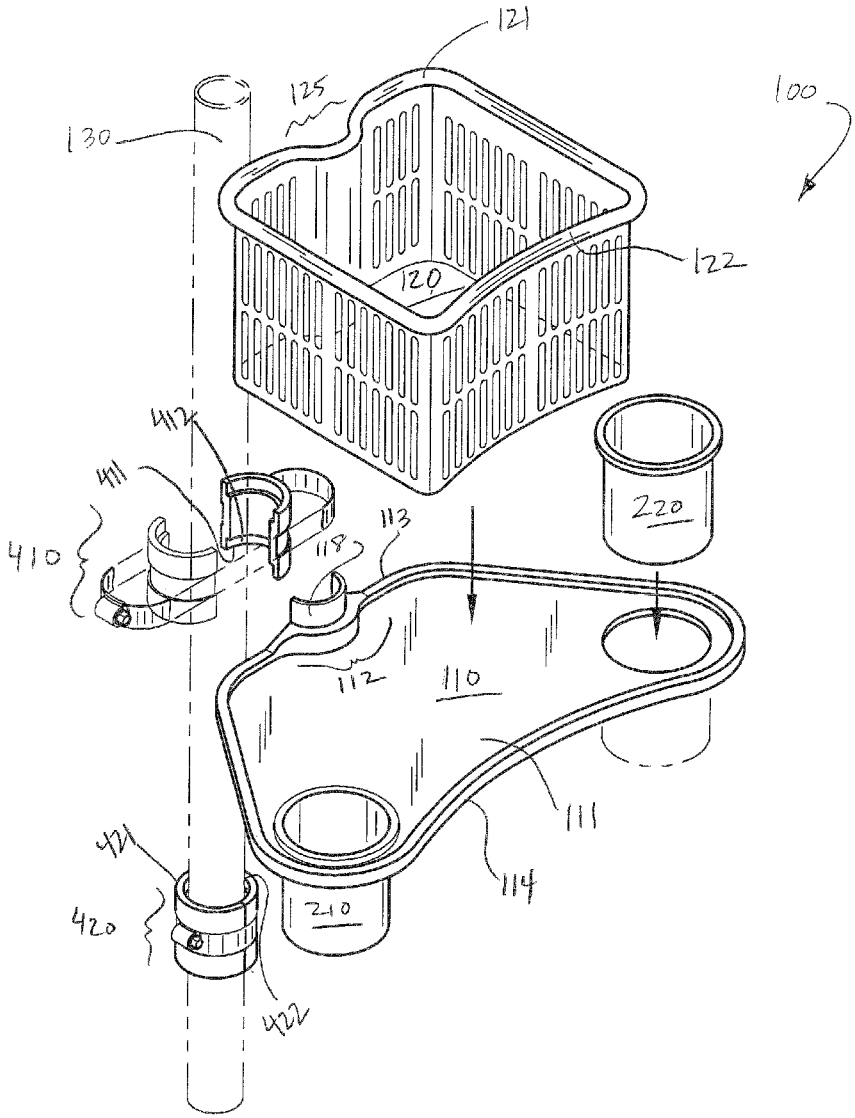
FIG. 1 is a perspective view of the clothesline apparatus of the present invention.
Figure 2:
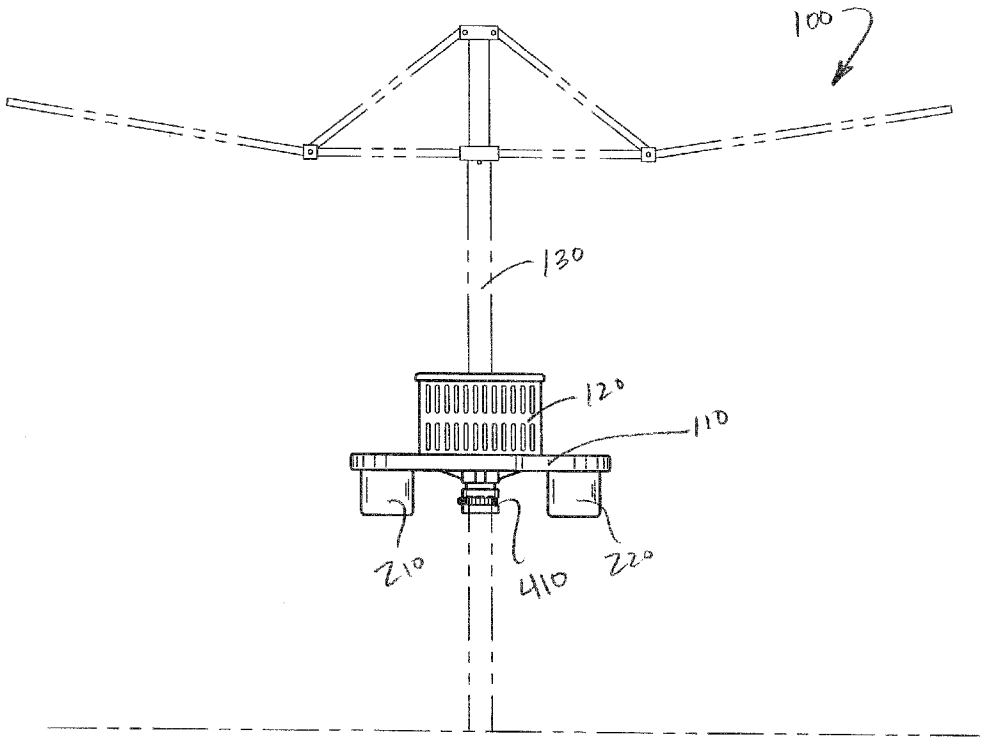
FIG. 2 is front view of the clothesline apparatus of the present invention as used on a clothesline pole.

The following is a listing of numbers corresponding to a particular element refer to herein:

100 clothesline apparatus
110 bench component
111 upper surface of bench component
112 first indentation on back edge of bench component
113 back edge of bench component
114 front edge of bench component
118 first wing
119 second wing
120 basket
121 back edge of basket
122 front edge of basket
125 second indentation on back edge of basket
130 clothesline pole
210 first container
220 second container
320 wall
410 first clamp
411 bottom edge
412 first gap
420 second clamp
421 upper edge

422 second gap
450 wall plate
455 screw

Referring now to FIGS. 1-5, the present invention features a clothesline apparatus 100 for holding a laundry basket and/or clothes pins. The clothesline apparatus 100 comprises a bench component 110 having an upper surface 111, a lower surface, a front edge 114, and a back edge 113. A first indentation 112 is disposed at the back edge 113 of the bench component 110. A first wing 118 extends upwardly from the first indentation 112 such that it is generally perpendicular to the top surface 111 of the bench component 110. The first wing 118 is curved and forms a shape similar to a half cylinder. A second wing 119 extends downwardly from the first indentation 112 such that it is generally perpendicular to the lower surface of the bench component 110. The second wing 119 is curved and forms a shape similar to a half cylinder.

A basket 120 having a front edge 122 and a back edge 121 can be placed on the upper surface 111 of the bench component 110. A second indentation 125 is disposed at the back edge 121 of the basket 120.

The clothesline apparatus 100 further comprises a first container 210 and a second container 220 removably attached to the bench component 110 near the front edge 114. In some embodiments, the containers are for storing clothes pins and/or the like. In some embodiments, more than two containers are removably attached to the bench component 110.

Figure 3:
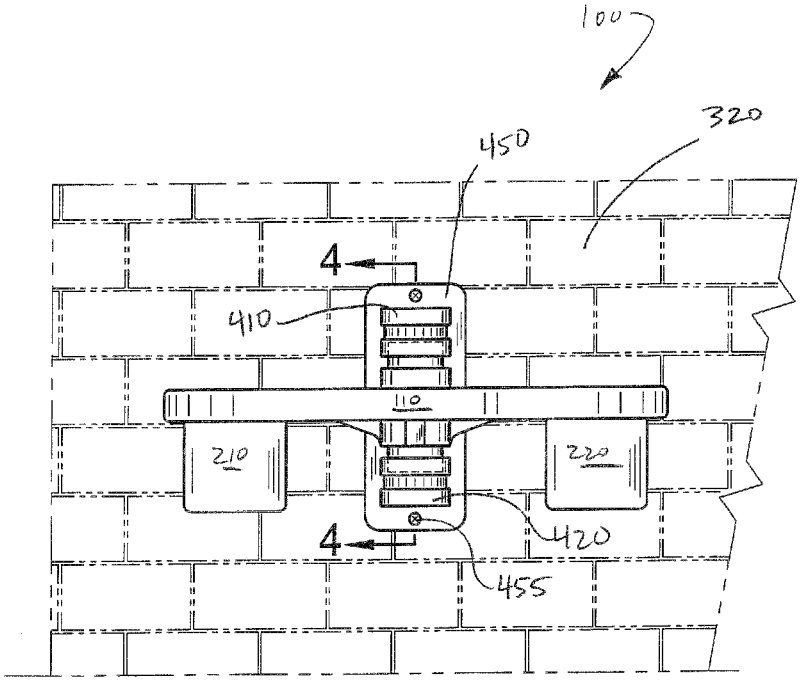
FIG. 3 is a front view of the clothesline apparatus of the present invention as used on a wall.
Figure 4:
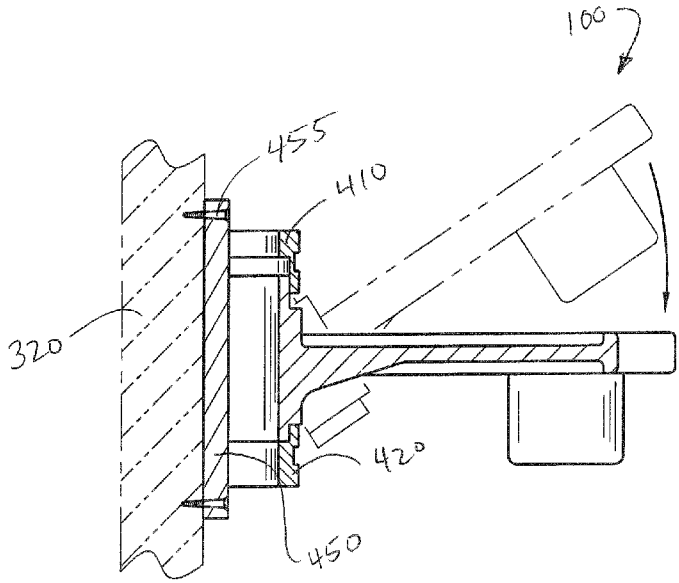
FIG. 4 is a side view of the clothesline apparatus of the present invention as used on a wall.
Figure 5:
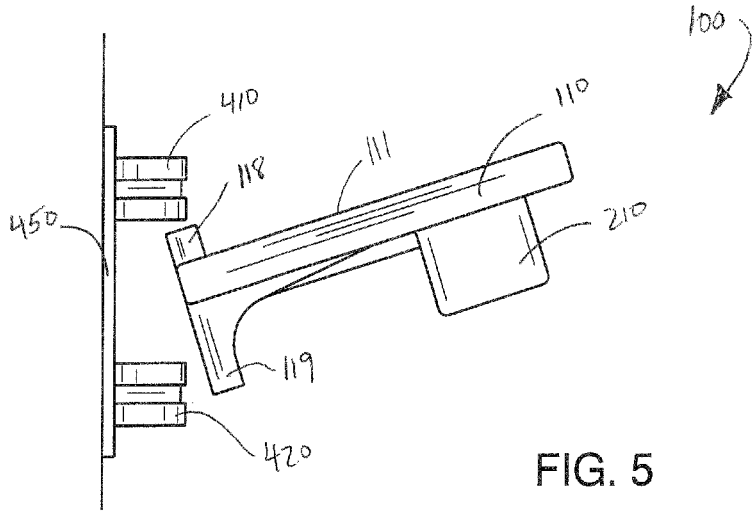
FIG. 5 is a side view of the clothesline apparatus of the present invention as used on a wall.

In some embodiments, the clothesline apparatus 100 is used on a wall 320 (see FIG. 3). In some embodiments, the clothesline apparatus 100 is used on a vertical clothesline pole 130 (see FIG. 2).

The bench component 110 can be attached to a clothesline pole 130 or a wall 320 via a first clamp 410 and a second clamp 420. The clothesline pole 130 can be fitted into the first indentation 112, the first wing 118, and the second wing 119 of the bench component 110. The first indentation 112 helps the bench component 110 snugly fit onto the clothesline pole 130. The clothesline pole 130 can be fitted into the second indentation 125 of the basket 120. The second indentation 125 helps the basket 120 snugly fit onto the clothesline pole 130.

The first clamp 410 and second clamp 420 can wrap tightly around the clothesline pole 130. Such clamps are well known to one of ordinary skill in the art. The first clamp 410 has a bottom edge 411 and a first gap 412 at the bottom edge 411. The first gap 412 can snugly fit around the first wing 118 of the bench component 110. The second clamp 420 has an upper edge 421 and a second gap 422 at the upper edge 421. The second gap 422 can snugly fit around the second wing 119 of the bench component 110. To attach the bench component 110 to the clothesline pole 130, a user can wrap the first clamp 410 around the clothesline pole 130 and simultaneously wrap the first gap 412 around the first wing 118. A user can then wrap the second clamp 420 around the clothesline pole 130 and simultaneously wrap the second gap 422 around the second wing 119.

In some embodiments, the first clamp 410 and the second clamp 420 can be attached to a wall plate 450 via an attachment means (e.g., a screw, a nail, a magnet, the like, or a combination thereof). The wall plate 450 can be attached to a wall via an attachment means such as a screw 455 (see FIG. 3). An attachment means can also include a nail, a magnet, the like, or a combination thereof. A user can attach the bench component 110 to the first clamp 410 and second clamp 420 by tightly wrapping the first clamp 410 around the first wing 118 and the second clamp 420 around the second wing 119 (see FIG. 4, FIG. 5).

The bench component 110 may be attached to the clothesline pole 130 at various heights. For example, the bench component 110 may be attached to the clothesline pole 130 such that the bench component 110 is between about 1 to 3 feet above the ground surface. In some embodiments, the bench component 110 may be attached to the clothesline pole 130 such that the bench component 110 is between about 3 to 5 feet above the ground surface.

As used herein, the term "about" refers to plus or minus 10% of the referenced number. For example, an embodiment wherein the bench component 110 is about 5 feet above the ground surface includes an embodiment wherein the bench component 110 is between 4.5 and 5.5 feet above the ground surface.

The clothesline apparatus 100 may be constructed from a variety of materials. For example, in some embodiments, the bench component 110 is constructed from a material comprising a metal, a plastic, a wood, the like, or combinations thereof. In some embodiments, the first container 210 and/or second container 220 is constructed from a material comprising a metal, a plastic, a wood, the like, or combinations thereof. In some embodiments, the basket 120 is constructed from a material comprising a metal, a plastic, a wood, the like, or combinations thereof.

The disclosures of the following U.S. Patents are incorporated in their entirety by reference herein: U.S. Pat. No. 5,277,488; U.S. Pat. No. 5,294,012; U.S. Pat. No. 5,934,634; U.S. Pat. No. 6,666,153; U.S. Pat. No. 6,688,238.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A clothesline apparatus for attaching to a clothesline pole or a wall, said clothesline apparatus comprising:

(a) a bench component having an upper surface, a lower surface, a front edge, and a back edge, wherein a first indentation is disposed at the back edge of the bench component; wherein a half-cylinder shaped first wing extends upwardly from the first indentation such that it is generally perpendicular to the top surface of the bench component; wherein a half-cylinder shaped second wing extends downwardly from the first indentation such that it is generally perpendicular to the lower surface of the bench component;

(b) a basket for holding clothes, said basket having a front edge, a back edge, and a second indentation disposed at the back edge of the basket; wherein the basket can be placed onto the upper surface of the bench component; wherein the second indentation helps the back edge of the basket fit snugly against the clothesline pole;

(c) a first container and a second container, wherein the first container and second container are both removably attached to the bench component near the front edge of the bench component by being inserted into holes in the bench component, wherein the first container and second container are for storing clothes pins or the like; and (d) a first clamp having a bottom edge and a second clamp having an upper edge, wherein the first clamp and the second clamp can wrap tightly around the clothesline pole by tightening each clamp by turning its attached captive screw; wherein the first clamp has a first gap at the bottom edge wherein the first gap can snugly fit around the first wing of the bench component as the tightened clamp causes the first gap to close around the first wing; wherein the second clamp has a second gap at the upper edge, wherein the second gap can snugly fit around the second wing of the bench component as the tightened clamp causes the second gap to close around the second wing;

wherein a user can attach the bench component to the clothesline pole by wrapping the first clamp around both the clothesline pole and the first wing, and wrap the second clamp around both the clothesline pole and the second wing: wherein the first indentation, first wing, and second wing each help the back edge of the bench fit snugly onto the clothesline pole, since the first indentation accommodates the shape of the clothesline pole and the first wing and second wing are removably attached to the clothesline pole by the first clamp and second clamp, respectively.

2. The clothesline apparatus of claim 1, wherein the first clamp and the second clamp can be attached to a wall plate via an attachment means, such as a screw, a nail, or a magnet, wherein the wall plate is for attaching to the wall.

* * * * *